United States Patent [19]

Twohy

[11] Patent Number: 4,913,027

[45] Date of Patent: Apr. 3, 1990

[54] VIOLIN HOLDER

[76] Inventor: Mark Twohy, 271 Laussat St., San Francisco, Calif. 94117

[21] Appl. No.: 240,210

[22] Filed: Sep. 6, 1988

Related U.S. Application Data

[63] Continuation-in-part of Ser. No. 139,742, Dec. 30, 1987, abandoned.

[51] Int. Cl.[4] ..... G10D 3/18
[52] U.S. Cl. ..... 84/280
[58] Field of Search ..... 84/278, 280, 281

[56] References Cited

U.S. PATENT DOCUMENTS

| | | | |
|---|---|---|---|
| 451,744 | 5/1891 | Albert | 84/278 |
| 2,061,464 | 11/1936 | Heimers | 84/280 |
| 4,389,916 | 6/1983 | Ruthstrom | 84/278 |

*Primary Examiner*—Lawrence R. Franklin
*Attorney, Agent, or Firm*—Thomas M. Freiburger

[57] ABSTRACT

A violin holder which slips onto the chest and shoulder of a musician retains a violin in the playing position with good stability, avoiding the need for the musician to cradle the instrument between his shoulder and chin. The violin holder is light in weight and of low profile, barely visible on the musician. In preferred embodiments it dismantles and folds and can be stored in a standard violin case along with the violin.

20 Claims, 3 Drawing Sheets

10
12
14
16
18
20
22
24
26
28
28a
29
29a
32
34
36
38
40
42
44
48
50
52
62
68
69

VIOLIN HOLDER

REFERENCE TO RELATED APPLICATION

This application is a continuation-in-part of application Ser. No. 139,742, filed Dec. 30, 1987, now abandoned.

BACKGROUND OF THE INVENTION

The invention relates to musical instruments, and is particularly concerned with a holder for violins and violas, to enable the musician to play the instrument without having to engage it between his neck and shoulder.

Violin holders and various other instrument holders have been suggested in several forms previous to this invention. For example, see U.S. Pat. Nos. 413,807, 1,337,459, 2,240,696, 2,576,018, 3,619,470 and 4,586,418, as well as U.K. Pat. No. 447,576 and German Pat. No. 718,440. The instrument holders shown in these patents, however, have suffered from several disadvantages. They have not provided the instrument stability of the present invention; they have not been easily set up and secured to the body of the musician; they have not been of sufficiently low profile and sufficiently unobtrusive when the musician is playing; they have not been sufficiently adjustable as to position for accommodating different users; and they have not been as compactly storable as the present invention, so as to be easily stored in a violin case along with the violin (or viola).

These concerns are addressed by the features of the present invention described below.

SUMMARY OF THE INVENTION

In accordance with the present invention, a holder for a violin, viola or other shoulder-engagable musical instrument is configured so as to rest over the shoulder of the musician (the opposite shoulder from that at which the violin is held) and engage the back, shoulder and upper chest of the musician. The holder may be formed in three separate pieces which are attached together for use: the shoulder-engaging portion or body harness; a bracket member or adjuster which attaches to the body harness at the front of the user near the chest; and an instrument clip which connects to the back of the instrument, preferably snapping into place, and to which the adjuster or bracket member connects preferably at two points. Stability of the instrument is achieved in part through the engagement of the instrument clip at two spaced points, giving stability along through the length of the instrument, and also by the manner in which the body harness and optionally the adjuster member engage the user.

The violin support constructed in accordance with the invention is very stable. One edge of the instrument will normally rest on the shoulder of the musician (usually the left shoulder), but the musician need not use his chin to help hold the instrument.

In a preferred embodiment, the body harness of the violin support device has pivoted portions at both ends. These ends, which are curved and engage around the back and generally against the torso, are rigid in the opened position of use, but will fold to a compact position for storage of the body harness in the violin case. The three components of the violin support device are configured so as to be easily stored in the violin case along with the violin.

The body harness has a particular shape and curvature which resists twisting rotation of the instrument to the musician's left, around toward the back. In this way, the body harness alone lends great stability to the instrument support device of the invention. All of the violin's weight is supported by the body harness (except to the extent the instrument rests on the left shoulder).

Full adjustability of the violin support device is an important feature of the invention. This is achieved primarily at the bracket member or adjuster, which has two rods extending to connections with the instrument clip attached to the violin. Both of the rods are adjustably connected to the adjuster member so as to be slidable forward or back, affecting the position of the instrument relative to the user and accommodating widely varying sizes of users. Both of the rods are also able to pivot in any direction from the adjuster member, so that the instrument can be swung upwardly or downwardly and inwardly or outwardly for achieving the optimum instrument position for the particular musician. The adjustable connection also permits the orientation or tilt of the instrument to be adjusted as desired. All of these adjustments may be made simply by loosening two adjustment clamps, then manipulating the instrument in virtually any direction until the desired position and orientation are reached, then re-tightening the two clamps.

In a preferred embodiment, the adjuster clamps each comprise a split ball type device which holds the rod between the halves of the ball, with an outer clamp over the ball conformed to the shape of the ball, so that when the clamp is loosened, rotation of the ball in the clamp, as well as sliding of the rod in the ball, are permitted but all such movements are prevented upon tightening of the clamp.

The adjustment of the instrument support device is independent of the collapsibility of the device. Once adjusted to optimum fit for a particular musician, the instrument support can be dismantled or collapsed without affecting the adjustments.

Another feature of the invention is a chest engager, connected to or forming a part of the adjuster member. The padded engager gives stability of the instrument with respect to preventing swinging of the instrument around the body, toward the back. The chest engager is not essential (because of twisting resistance provided by the body harness), but maximizes stability of the instrument. It has several adjustments which enable variation in the position at which it engages the chest as well as the degree of extension of the chest engager from the main part of the adjuster member, for optimizing the spacing of the adjuster member out from the chest. The configuration of the instrument clip and the manner in which it is secured to the instrument, as well as the way in which the two rods engage in the instrument clip, are also important features of the invention.

It is therefore among the objects of the invention to improve over past instrument support devices by providing a violin/viola support which is very easily assembled and secured to the body, which is of very low profile in use, virtually unnoticeable on the musician, and which provides a highly stable support for the instrument, eliminating the need for the musician to use his neck and chin for retaining the instrument in place during playing. These and other objects, advantages and features of the invention will be apparent from the following description of a preferred embodiment, considered along with the accompanying drawings.

DESCRIPTION OF PREFERRED EMBODIMENT

Figures 1, 6:
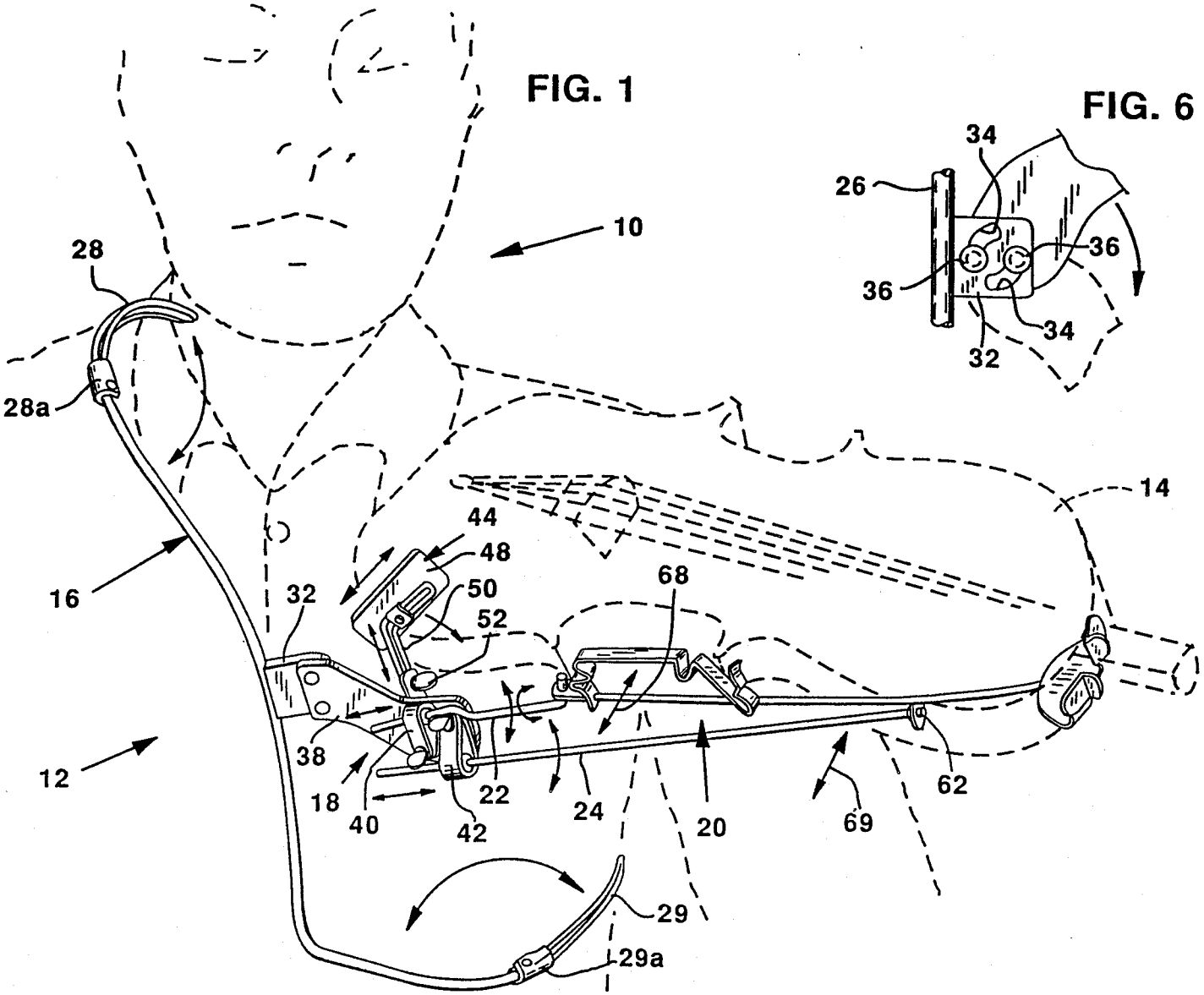
FIG. 1 is a perspective view showing the instrument supporting device of the invention as secured to the body of a musician, and supporting a violin.
FIG. 6 is a detail view indicating the connection of the adjuster member to the body harness.

In the drawings, FIG. 1 shows a musician 10 wearing an instrument support apparatus in accordance with the invention, generally identified by the reference number 12. The instrument support 12 holds a violin 14 or viola (or other similar shoulder-engagable instrument) at the left shoulder of the musician, so that the near base edge of the instrument rests on the musician's left shoulder, but avoiding the need for the musician to hold the instrument in place using his neck or chin, as is conventional.

The instrument support apparatus 12 includes a body harness or shoulder engaging portion 16, an adjuster bracket or connector 18, an instrument clip 20 and a pair of instrument supports 22 and 24 which extend from the adjuster bracket 18 to the instrument clip 20, and which may be considered as parts of the adjuster bracket 18. FIGS. 2 through 8 show details of the various components of the instrument support device, and the following discussion refers to all of the drawing figures.

As illustrated, the instrument support device 12 of the invention is preferably of low profile when worn by the musician, so as to be unobtrusive and hardly noticeable when a musician plays. The body harness or shoulder-engaging device 16 thus comprises a relatively thin but high-strength rod-like member 26, preferably with upper and lower end pieces 28 and 29 which are connected to the rod 26 by pivot connections 28*a* and 29*a*, so that these end pieces can be swung to a folded, closed position as shown in FIG. 5 for compact storage.

As shown particularly in FIG. 1, the body harness member 16 does not engage the neck of the user, as was common in previous instrument holders, but instead rests on the right shoulder of the musician and hooks over the shoulder to engage the upper back below the back. In the front, the rod member 26 comes down generally vertically, closely adjacent to the chest, then makes a left turn (with respect to the musician) to curve part way around the mid or lower left abdomen of the musician as shown. The pivotable extension 29 at this lower end forms a part of the abdomen curve. Thus, the principal engagement of the body harness member 16 with the user is at the right shoulder and upper back, to some extent along the upper chest and middle chest, and at the mid or lower left abdomen (for a right-handed musician as shown). As can be envisioned from FIG. 1, the contour engagement at the right shoulder and at the left abdomen alone will afford a great deal of positional stability of the body harness on the musician. The opposed ends 28 and 29 of the harness are separated by sufficient distance that the weight and playing pressure of the instrument 14 have minimal leverage toward straining the shoulder or putting uncomfortable pressure on any other point.

Figure 5:
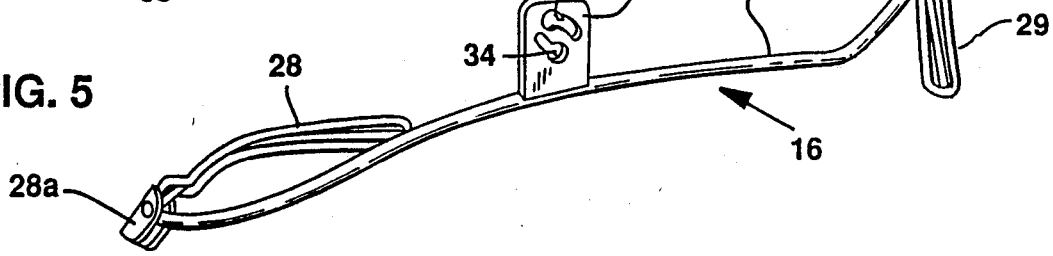
FIG. 5 is a perspective view showing a body harness portion of the instrument support device, disconnected from the adjuster member and with two pivoted ends folded to the storage position which enables the component to be stored in a violin case along with the violin.

As shown in FIGS. 1 and 5, the body harness member 16 includes a connector bracket 32 for connection to the adjuster bracket 18. This bracket may have a pair of opposed curving pear-shaped holes 34, as illustrated, for engagement by a pair of fastener heads 36, seen in FIG. 6. Thus, the adjuster member 18 with its fastener heads 36 is pushed into the pear-shaped holes 34 and rotated to lock the two components together in the known manner, as illustrated in FIG. 6.

Figure 4:
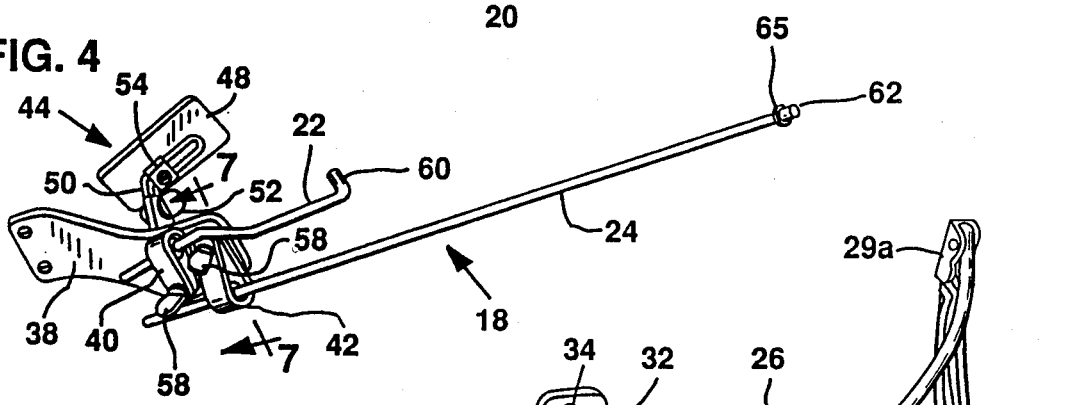
FIG. 4 is a perspective view showing an adjuster member which forms a component of the instrument support device, and which includes a chest engaging pad and a pair of rods which connect with the instrument clip.

The adjuster member or adjuster bracket 18 is configured generally as shown in FIGS. 1 and 4. It comprises a base plate 38 which may be curved as shown, a pair of universal clamps 40 and 42, the instrument support rods 22 and 24, and a chest pad 44.

The adjuster 18 affords many adjustments of the instrument support apparatus, for accommodating different users and varying positions of comfort. These adjustments are indicated in FIGS. 1, 4, 7 and 8. The base plate member 38 is secured to the two universal clamps 40 and 42, with this opposite end of the base plate extending out farther away from the chest of the musician.

In a preferred embodiment, the adjuster bracket or adjuster member 18 also includes the chest engaging pad 44 which comprises a generally flat padded member 48 and a connector leg 50 which preferably is slotted and has a clamp screw 52 for adjusting the extension of the pad toward the chest and also controlling the angular position of the pad. The pad is connected to the extension leg by a further adjustment member 54, which permits sliding adjustment of the pad left and right as viewed in FIGS. 1 and 4 and may also permit further tilt control of the pad. In use, the pad 44 does not serve to support weight, but rather it adds further resistance to twisting of the instrument around the musician's left, toward his back.

Figure 7:
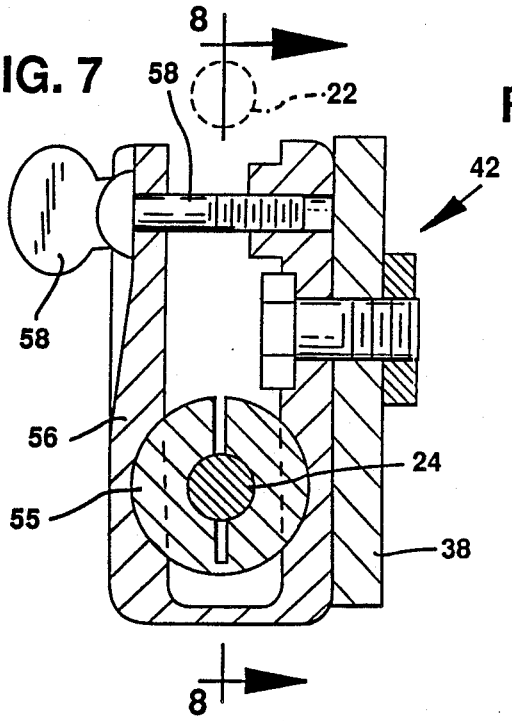
FIG. 7 is an enlarged detail sectional view showing a split ball type adjustable connection between an instrument support rod and the adjuster member, as used in a preferred embodiment of the invention, and as viewed along the line 7—7 in FIG. 4.
Figure 8:
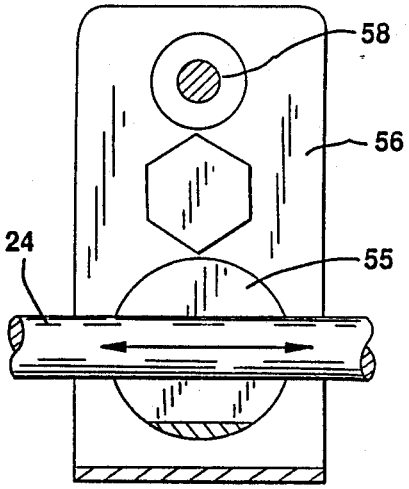
FIG. 8 is another sectional view of the adjustable connector, as seen along the line 8—8 in FIG. 7.

The two instrument support rods 22 and 24 are secured into the universal clamps 40 and 42, as shown in FIGS. 1 and 4 and particularly in FIGS. 7 and 8. In a preferred embodiment, these clamps each comprise a split ball 55 which has inner surfaces contoured to receive the cylindrical rod exterior, and a clamping member 56 which is contoured to receive the ball and permit rotation of the ball when a tightening screw 58 is somewhat loosened. Thus, when the tightening screws 58 are loosened, the rods can be pivoted to swing in virtually any direction, in more than one plane, and at the same time they can be adjusted slidably, for more or less extension from the universal clamps 40 and 42.

Figure 3:
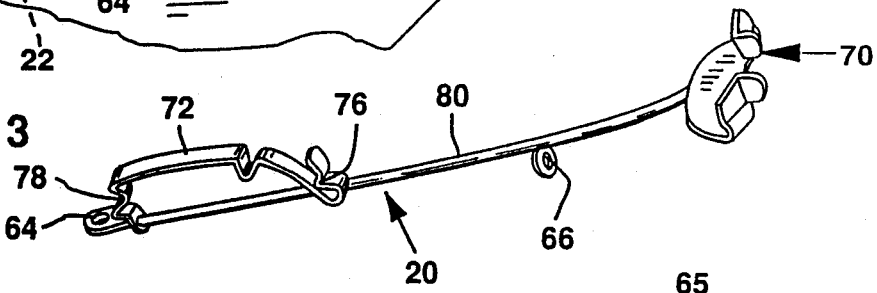
FIG. 3 is a perspective view showing the instrument clip detached from the violin.

As also illustrated in FIGS. 1 and 4, the instrument supports 22 and 24 preferably have connecting ends 60 and 62 which engage with the instrument clip 20 on different axes. Thus, the shorter instrument support 22 has a generally right-angled end 60 for receipt in a complimentarily oriented hole 64 in the instrument clip (FIG. 3), while the longer instrument support 24 merely has a collar 65 as its connecting end for receipt of the rod end in a complimentarily arranged bore 66 of the instrument clip (FIG. 3). In this way, the first instrument support rod connection 60 locates the instrument clip on the adjuster member 18 but would permit pivoting of the instrument clip about the axis of the bore 64 on the instrument clip. The instrument support connection 62/65, however, prevents such rotation and the two connections 60 and 62/65 compliment each other to prevent any significant swinging or pivoting of the instrument. At the same time, these connections permit easy assembly of the instrument clip onto the instrument supports 22 and 24, by first inserting the rod end 62 in the hole 66, then the other rod end 60 in the hole 64. Rubber tips or sleeves or coatings (not specifically shown) preferably are included on the rod ends 60 and 62, for effecting a friction fit of these ends with the respective holes in which they are received. This helps the rods or instrument supports 22 and 24 to follow the movements of the instrument clip 20 during adjustment, without slipping out.

When the position of the instrument is being adjusted (with the tightening screws 58 loosened), the rods 22 and 24 and the instrument 14 can be swung in and out as indicated by arrows 68 and 69 in FIG. 1, due to the geometry of the apparatus. This helps the musician achieve optimum positioning.

It should be noted that adjustment of the instrument support of the invention, as illustrated and described, requires no tools.

The geometry of the instrument support is such that primarily a pulling and bending force is imposed on the shorter instrument support rod 22, and essentially only a compressive force on the longer rod 24. This allows the use of relatively thin and unobtrusive rods, on the order of $\frac{1}{8}$ inch diameter.

Figure 2:
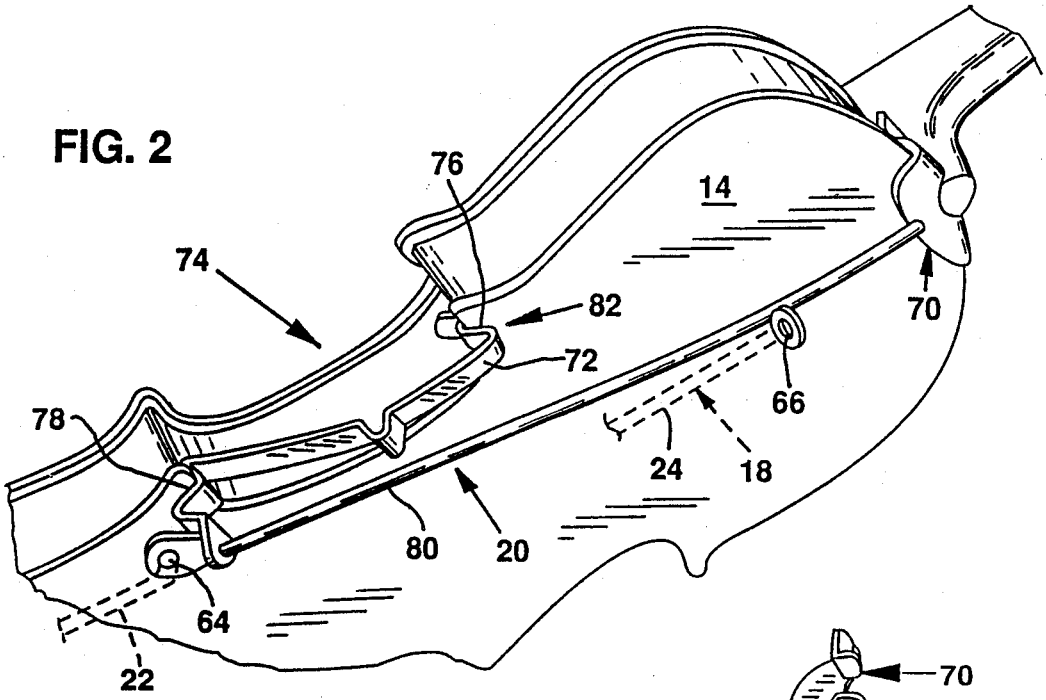
FIG. 2 is a perspective view showing the connection of an instrument clip of the instrument support device to the back side of the violin.

FIGS. 2 and 3 show in greater detail the instrument clip 20, which is an important feature of the invention. With this instrument clip 20, no screws, bolts or screw clamps are required, which might deface or mar the surface of the instrument. The instrument clip includes a front or top end 70, preferably padded as with felt, for engaging onto the neck end of the violin box at the heel at the base of the neck, as shown particularly in FIG. 2. The remainder of the connection to the violin (or other instrument) is made by a cove clip 72 which snaps into the cove 74 at the side of the instrument, and the contacting surfaces of this cove clip preferably are also padded. The cove clip 72 is essentially a spring, with snap-locking detents or recesses 76 and 78 as illustrated, for engaging ridges of the instrument as illustrated. The bottom end of the cove clip is secured to a rod or elongated spin member 80 of the instrument clip, adjacent to the connector hole 64, while the other end 82 of the cove clip preferably floats.

In this way, the instrument clip 20 readily snaps onto the back of the instrument as shown, with padding at appropriate contact locations, so that it holds securely to the instrument without marring any surfaces of the instrument. The "back" side of the instrument, herein and in the claims, refers to that side opposite the side with the strings (which is considered the front). When the clip points 70 and 78 are positioned against respective ridges of the violin, the clip recess 76 is resting just above the ridge it locks onto. Pushing with the thumb on the end 82 then snaps the cove clip into place, locking the instrument clip 20 to the instrument.

Figure 9:
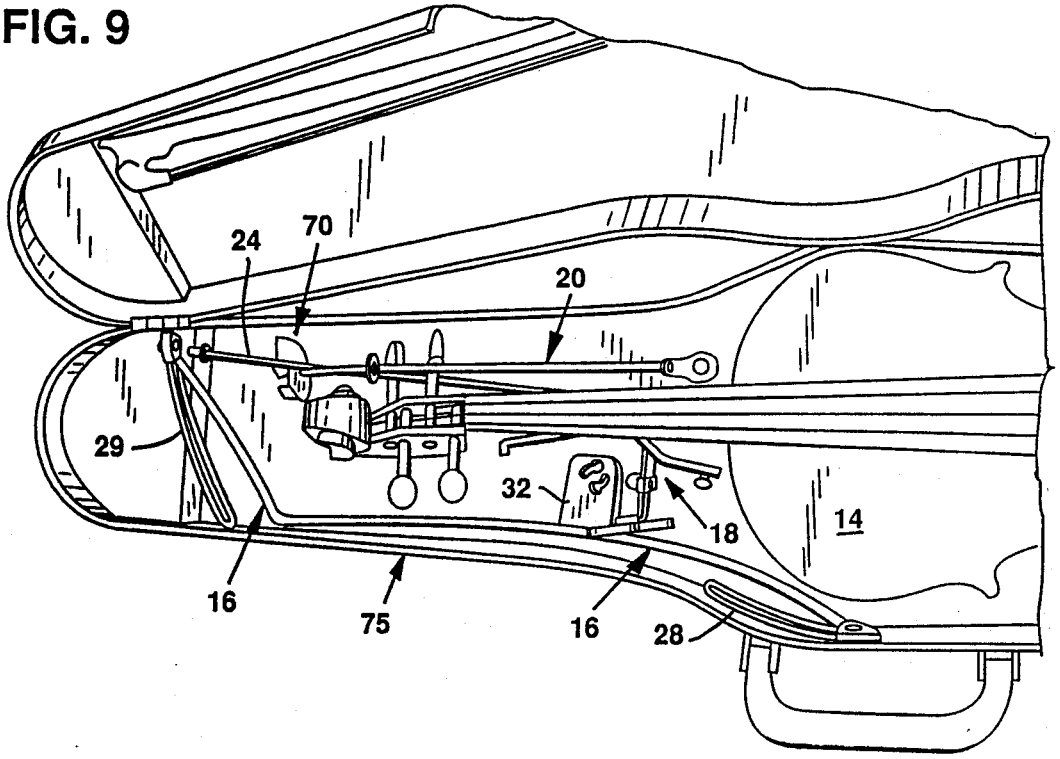
FIG. 9 is a view showing the components of the instrument support device stored in a violin case along with the violin.

FIG. 9 shows the instrument support apparatus 12 of the invention dismantled into three separate components 16, 18 and 20 and positioned in a violin case 75 along with the violin 14. With the preferred construction illustrated and described above, including the pivoted end members 28 and 29 on the body harness device 16, folded as shown, the instrument support 12 is easily stored in the violin case. All of the components are positioned generally in the neck end of the case as shown.

It should be understood that the terms "right" and "left" can be interchanged in the above description for a left-handed violin player, and these terms and the embodiment shown in the drawings are used for convenience in describing the invention in the context of a right-handed musician.

The above described preferred embodiment illustrates the principles of the present invention, but is not intended to limit the scope of the invention. Other embodiments and variations to these preferred embodiments will be apparent to those skilled in the art and may be made without departing from the scope of the invention as defined in the following claims.

I claim:

1. A support for a shoulder-engagable musical instrument such as a violin or viola, for supporting the instrument on a musician's body and avoiding the need for gripping the instrument between the musician's shoulder and chin, comprising, body harness means for fitting onto the body of the musician user and for engaging the back, one shoulder, the front and a portion of the abdomen of the musician, around a side of the abdomen opposite said one shoulder;

instrument clip means for securing to the back side of the instrument, the instrument clip means including two support connection means; and adjuster bracket means for connecting to the body harness means at the front of the musician and including instrument support means having end means for connection to said support connection means on the instrument clip means, and further including adjustment means for adjustment of the position and orientation of the instrument support means to afford a full range of adjustment of the instrument in positions adjacent to the musician's other shoulder, the musical instrument support thereby stably supporting the instrument on the musician in position to be played, without engagement of the chin with either the instrument support or the instrument.

2. The musical instrument support according to claim 1, wherein the instrument support means comprise a pair of elongated support rods, with base ends secured to said adjustment means, and the adjustment means comprising universal clamp means for enabling extension and retraction of each of the rods, as well as pivoted movement of each of the rods in more than one plane.

3. The musical instrument support according to claim 2, wherein the support connection means comprises a pair of brackets on the instrument clip means, each with a bore for receiving an end of a rod, and the two bores being on different axes for adding stability to the instrument.

4. The musical instrument support according to claim 1, wherein the adjuster bracket means further includes a chest pad extending toward the upper chest of the user for stabilizing the instrument support means against the upper chest of the user and helping prevent rotational swinging of the instrument around toward the musician's back.

5. The musical instrument support according to claim 4, wherein the chest engaging pad includes means for adjusting the position of the pad in and out with respect to the chest and angularly, for adjustment of the position at which the pad engages the chest.

6. The musical instrument support according to claim 1, wherein the body harness means and the adjuster bracket means include quick connection means for securing them together.

7. The musical instrument support according to claim 1, wherein the body harness means comprises a rod-like member curved and formed into an appropriate shape for engagement of the musician, with pivoted, folded ends on the rod-like member for engaging the back of the musician and the lower abdomen on the front and opposite side of the musician, and for pivoting to a closed position for compact storage.

8. The musical instrument support according to claim 1, wherein the instrument clip means includes means for quickly and easily snapping the instrument clip means to the back side of the instrument, including means for engagement into a cove at the side of the instrument, snapping into the cove from the back side of the cove.

9. A support for a shoulder-engagable musical instrument such as a violin or viola, for supporting the instrument on a musician's body and avoiding the need for gripping the instrument between the musician's shoulder and chin, comprising, body harness means for engaging one shoulder and at least the torso of the musician without applying pressure to the neck, and for preventing swinging of the instrument around the opposite shoulder, toward the back, instrument clip means for securing to the back side of the instrument, with substantially the entire instrument clip means at the back side of the instrument and not protruding to the side or front, and including means for quickly and easily snapping the instrument clip means onto the instrument, adjuster bracket means for connection to the body harness means, such that it is supported by the body harness means, and for connection to the instrument clip means for supporting the instrument, and including adjustment means for affording a full range of adjustment of the instrument in positions adjacent to the musician's said opposite shoulder.

10. The musical instrument support of claim 9, wherein the adjuster bracket means includes a pair of instrument support rods extending to support the instrument, with the instrument clip means including support connection means for receiving ends of the instrument support rods, whereby the instrument is supported at two points from the adjuster bracket means.

11. The musical instrument support of claim 9, wherein the adjuster bracket means further includes a chest pad extending toward the upper chest of the user for stabilizing the instrument support against the upper chest of the user and helping prevent rotational swinging of the instrument around toward the musician's back.

12. The musical instrument support of claim 9, wherein the body harness means, the instrument clip means and the adjuster bracket means include means for quick connection and disconnection from each other, and wherein each is configured to be storable in a violin case with a violin, generally in the neck end of the violin case.

13. The musical instrument support of claim 12, wherein the body harness means includes opposite end portions each of which is pivoted and foldable so as to shorten the length of the body harness means, for fitting the body harness means into the neck portion of the violin case.

14. The musical instrument support of claim 9, wherein the body harness means is configured so as to engage and partially wrap around the torso on the side of the musician opposite said one shoulder.

15. The musical instrument support of claim 14, wherein the body harness means is configured to also engage the chest of the musician, generally below the neck.

16. The musical instrument support of claim 9, wherein the body harness means comprises a generally rod-like member having an upper end which curves around and over the musician's shoulder and engages a portion of the back, just below the neck, and with an intermediate portion which is configured to extend down and bear against the chest, generally below said one shoulder, then continuing downward generally vertically and centrally on the front of the musician, terminating in a lower end portion which is configured to curve around into contoured engagement with the lower torso on the side of the musician opposite said one shoulder, above the waist.

17. The musical instrument support of claim 26, wherein the body harness means further includes foldable end members at both its upper and lower ends, for pivoting and folding the end members compactly against the remainder of the body harness means to shorten the length of the body harness means for storage.

18. The instrument support of claim 9, wherein the adjustment means of the adjuster bracket means includes clamp means for affording said full range of adjustment of the instrument, with only two manually operable clamps which are loosened to provide such adjustment movement.

19. The musical instrument support of claim 9, wherein the instrument clip means includes means for engagement into a cove at the side of the instrument, snapping into the cove from the back side of the cove.

20. The musical instrument support of claim 19, wherein the instrument clip means further includes neck heel engaging means for snapping onto the instrument body at the heel, at the base of the neck, and wherein only said cove and the instrument body at said heel are engaged by the instrument clip means.

* * * * *